US006430018B2

(12) United States Patent
Machida

(10) Patent No.: US 6,430,018 B2
(45) Date of Patent: Aug. 6, 2002

(54) THREE-ELECTRODE-DISCHARGE SURGE ARRESTER

(75) Inventor: Kazuhiko Machida, Nagano (JP)

(73) Assignee: Shinko Electric Industries Co., Ltd., Nagano (JP)

( * ) Notice: Subject to any disclaimer, the term of this patent is extended or adjusted under 35 U.S.C. 154(b) by 106 days.

(21) Appl. No.: 09/729,024

(22) Filed: Dec. 4, 2000

(30) Foreign Application Priority Data

Jan. 5, 2000 (JP) ..... 2000-000218

(51) Int. Cl.[7] ..... H02H 1/00
(52) U.S. Cl. ..... 361/120
(58) Field of Search ..... 361/117, 118, 361/120, 121, 129, 130, 128; 313/331, 335, 325

(56) References Cited

U.S. PATENT DOCUMENTS 4,134,146 A * 1/1979 Stetson ..... 174/DIG. 17
4,241,374 A 12/1980 Gilberts
4,266,260 A * 5/1981 Lange et al. ..... 361/120
4,321,649 A * 3/1982 Gilberts ..... 337/32
4,362,962 A * 12/1982 Lange ..... 174/94 R
4,433,354 A * 2/1984 Lange et al. ..... 313/306
4,644,441 A * 2/1987 Igarashi ..... 361/120
4,680,665 A * 7/1987 Bonnesen et al. ..... 313/231.11
5,336,970 A 8/1994 Einbinder

FOREIGN PATENT DOCUMENTS

| | | |
|---|---|---|
| FR | 2430083 | 1/1980 |
| FR | 2614145 | 10/1998 |
| JP | 556792 | 1/1989 |

* cited by examiner

*Primary Examiner*—Brian Sircus
*Assistant Examiner*—Danny Nguyen
(74) *Attorney, Agent, or Firm*—Ladas & Parry

(57) ABSTRACT

A three-electrode-discharge surge arrester has two opposing discharging parts of a pair of line electrodes, defining a gap therebetween, and a ground electrode disposed between the two discharging parts and provided with a penetration hole in the center. Each of the two discharging parts has a substantially conical shape. In accordance with this substantially conical shape, each of inner surfaces of upper and lower parts of the penetration hole of the ground electrode is substantially funnel-shaped. Hence, oblique parallel gaps for a primary discharge are formed between the substantially funnel-shaped inner surfaces of the upper and lower parts of the penetration hole and the two substantially conical discharging parts. Also, parallel gaps for a secondary discharge are formed between peripheral parts of the ground electrode around the penetration hole and peripheral parts of the line electrodes. Each of the oblique parallel gaps is formed narrower than each of the parallel gaps.

3 Claims, 4 Drawing Sheets

THREE-ELECTRODE-DISCHARGE SURGE ARRESTER

BACKGROUND OF THE INVENTION

1. Field of the Invention

The present invention generally relates to a three-electrode-discharge surge arrester and, more particularly, to a three-electrode-discharge surge arrester eliminating a surge current generated between two line wires and a ground wire.

2. Description of the Related Art

A description will now be given, with reference to FIG. 1, of a conventional three-electrode-discharge surge arrester.

The conventional three-electrode-discharge surge arrester has a pair of axially placed line electrodes 10 formed of metals such as Fe—Ni alloys, with a predetermined gap therebetween, so that cylindrically shaped discharging parts 12 provided respectively on the inner edges of the pair of line electrodes 10 oppose each other.

Between the opposing discharging parts 12 of the pair of line electrodes 10 is a ground electrode 20 provided with a penetration hole 28 in the center.

Between the ground electrode 20 and each of the line electrodes 10 is each of a pair of cylindrical insulating housings 30, within each of which the discharging part 12 of the line electrode 10 is inserted. The cylindrical insulating housings 30 are formed of insulators such as ceramic. Circular electric terminals 14 formed respectively on the outer side of the pair of line electrodes 10 seal the outer openings of the pair of cylindrical insulating housings 30 airtight. The cylindrical insulating housings 30 are placed airtight between each of the line electrodes 10 and the ground electrode 20.

A terminal 24 of the ground electrode 20 is held between the pair of cylindrical insulating housings 30. The circumference of the terminal 24 of the ground electrode 20 exposes itself between the pair of cylindrical insulating housings 30.

In the conventional three-electrode-discharge surge arrester shown in FIG. 1, two line wires (not shown in the figure) can be connected to the circular electric terminals 14 sealing the outer openings of the pair of cylindrical insulating housings 30, respectively. Also, a ground wire (not shown in the figure) can be connected to the terminal 24 of the ground electrode 20 exposing itself between the pair of cylindrical insulating housings 30. Then, a surge current generated between either of the two line wires and the ground wire can be eliminated by causing a discharge to occur in a gap between either of the discharging parts 12 of the line electrodes 10 and its opposing discharging part 22 of the ground electrode 20.

However, in the above-mentioned conventional three-electrode-discharge surge arrester, when a discharge occurs between each of the discharging parts 12 of the line electrodes 10 and its opposing discharging part 22 of the ground electrode 20, particles of metals such as Fe—Ni alloys forming the discharging parts 12 and 22 disperse from the discharging parts 12 and 22 by sputtering, to land on the inner peripheral surfaces of the cylindrical insulating housings 30. Then, the sputtered particles, unduly connected with conductive trigger lines 32, which are formed on the inner peripheral surfaces of the cylindrical insulating housings 30 and electrically connected to the line electrodes 10 and the ground electrode 20, cause deteriorated insulation between each of the line electrodes 10 and the ground electrode 20.

This prevents stable and accurate discharges from occurring repeatedly over a long period of time between each of the discharging parts 12 of the line electrodes 10 and its opposing discharging part 22 of the ground electrode 20.

SUMMARY OF THE INVENTION

It is a general object of the present invention to provide an improved and useful three-electrode-discharge surge arrester in which the above-mentioned problems are eliminated.

A more specific object of the present invention is to provide a three-electrode-discharge surge arrester which can cause stable and accurate discharges to occur repeatedly over a long period of time and can eliminate a surge current generated between two line wires and a ground wire.

In order to achieve the above-mentioned objects, there is provided according to the present invention a three-electrode-discharge surge arrester having two discharging parts of a pair of line electrodes, the two discharging parts opposing each other and defining a gap therebetween; a ground electrode disposed between the two discharging parts and provided with a penetration hole in the center thereof; and two cylindrical insulating housings between each of the line electrodes and the ground electrode, wherein each of the two discharging parts has a substantially conical shape; each of inner surfaces of upper and lower parts of the penetration hole is substantially funnel-shaped, in accordance with the substantially conical shape; and oblique parallel gaps for a primary discharge are formed between the inner surfaces of the upper and lower parts of the penetration hole and the two discharging parts, respectively, wherein parallel gaps for a secondary discharge are formed between peripheral parts of the ground electrode around the penetration hole and peripheral parts of the pair of line electrodes, respectively, each of the peripheral parts of the pair of line electrodes opposing each of the peripheral parts of the ground electrode around the penetration hole, and wherein each of the oblique parallel gaps is formed narrower than each of the parallel gaps.

The three-electrode-discharge surge arrester according to the present invention has the substantially conical discharging parts of the line electrodes. To suit this shape, the upper and lower parts of the penetration hole of the ground electrode each have the substantially funnel-shaped inner surfaces. Between each of the substantially conical discharging parts of the line electrodes and its opposing substantially funnel-shaped inner surface of the penetration hole of the ground electrode is the oblique parallel gap for a primary discharge.

Therefore, when a primary discharge occurs in the oblique parallel gaps formed between each of the substantially conical discharging parts of the line electrodes and each of the substantially funnel-shaped inner surfaces of the penetration hole of the ground electrode, metal particles are sputtered from the substantially conical discharging parts of the line electrodes and the substantially funnel-shaped inner surfaces of the penetration hole of the ground electrode. However, the sputtering is blocked by the ground electrode around the penetration hole and the discharging parts of the line electrodes, so that the sputtered metal particles are kept from landing on the inner peripheral surfaces of the cylindrical insulating housings each placed between the ground electrode and each of the line electrodes. This prevents deteriorated insulation, otherwise caused by the sputtering, between each of the line electrodes and the ground electrode.

Also, the metal particles sputtered from the substantially conical discharging parts of the line electrodes land on the opposing substantially funnel-shaped inner surfaces of the penetration hole of the ground electrode, and the metal particles sputtered from the substantially funnel-shaped inner surfaces of the penetration hole of the ground electrode land on the opposing substantially conical discharging parts of the line electrodes. Therefore, the substantially conical discharging parts of the line electrodes and the substantially funnel-shaped inner surfaces of the penetration hole of the ground electrode keep supplementing sputtered metals to each other.

This prevents changing significantly the width and length of the oblique parallel gaps between the substantially conical discharging parts of the line electrodes and the substantially funnel-shaped inner surfaces of the penetration hole of the ground electrode, because metals forming the substantially conical discharging parts of the line electrodes and the substantially funnel-shaped inner surfaces of the penetration hole of the ground electrode, respectively, keep supplementing each other and do not eventually disappear, when primary discharges occur repeatedly over a long period of time between the substantially conical discharging parts of the line electrodes and the opposing substantially funnel-shaped inner surfaces of the penetration hole of the ground electrode. Therefore, stable and accurate discharges at a predetermined electric potential occur repeatedly over a long period of time in the oblique parallel gaps between the substantially conical discharging parts of the line electrodes and the opposing substantially funnel-shaped inner surfaces of the penetration hole of the ground electrode.

Additionally, when a large surge voltage is provided between the line electrode and the ground electrode, a primary discharge occurring in the oblique parallel gaps between the substantially conical discharging parts of the line electrodes and the substantially funnel-shaped inner surfaces of the penetration hole of the ground electrode is followed by a secondary discharge occurring in the relatively wider parallel gaps between the peripheral parts of the ground electrode around the penetration hole and the opposing peripheral parts of the line electrodes. This secondary discharge occurring in the parallel gaps surely eliminates the above-mentioned large surge voltage.

Additionally, because the oblique parallel gaps are narrower than the parallel gaps, when a not quite as large surge voltage is provided between the line electrode and the ground electrode, a primary discharge occurs in the relatively narrower oblique parallel gaps between the substantially conical discharging parts of the line electrodes and the substantially funnel-shaped inner surfaces of the penetration hole of the ground electrode. This primary discharge occurring in the oblique parallel gaps surely eliminates the above-mentioned not quite as large surge voltage.

With this not quite as large surge voltage, since a secondary discharge does not occur in the relatively wider parallel gaps between the peripheral parts of the ground electrode around the penetration hole and the opposing peripheral parts of the line electrodes, metal particles are kept from sputtering from the peripheral parts of the ground electrode and the opposing peripheral parts of the line electrodes and landing on the inner peripheral surfaces of the cylindrical insulating housings. This prevents deteriorated insulation, otherwise caused by the sputtering, between each of the line electrodes and the ground electrode.

Additionally, because the discharging parts of the line electrodes are substantially conical and, to suit this shape, the inner surfaces of the upper and lower parts of the penetration hole of the ground electrode are substantially funnel-shaped, the area of each of the oblique parallel gaps formed therebetween for a primary discharge can be increased, compared with the conventional three-electrode-discharge surge arrester having substantially cylindrically shaped discharging parts of a pair of line electrodes and, correspondingly, substantially cylindrically shaped inner surfaces of upper and lower parts of a penetration hole of a ground electrode. Therefore, stable primary discharges occur repeatedly over a long period of time in the oblique parallel gaps increased in area.

Additionally, the substantially conical discharging parts of the line electrodes can be easily and surely formed by coining, compared with the substantially cylindrically shaped discharging parts of the line electrodes. This is remarkably effective especially when substantially conical small-sized discharging parts of a diameter equal to or less than 6 mm are formed by coining.

In the three-electrode-discharge surge arrester according to the present invention, discharge activating materials are preferred to be applied to the surfaces of the substantially conical discharging parts of the line electrodes and the substantially funnel-shaped inner surfaces of the upper and lower parts of the penetration hole of the ground electrode.

In the three-electrode-discharge surge arrester having this structure, the discharge activating materials applied to the surfaces of the substantially conical discharging parts of the line electrodes and the substantially funnel-shaped inner surfaces of the penetration hole of the ground electrode cause a primary discharge to occur smoothly and surely in the oblique parallel gaps between the substantially conical discharging parts of the line electrodes and the opposing substantially funnel-shaped inner surfaces of the penetration hole of the ground electrode.

Additionally, when a primary discharge occurs in the oblique parallel gaps formed between each of the substantially conical discharging parts of the line electrodes and each of the substantially funnel-shaped inner surfaces of the penetration hole of the ground electrode, particles of the discharge activating materials applied to the surfaces of the substantially conical discharging parts of the line electrodes and the substantially funnel-shaped inner surfaces of the penetration hole of the ground electrode disperse due to sputtering. However, the sputtered particles are blocked by the ground electrode around the penetration hole and the discharging parts of the line electrodes, so that the sputtered particles are kept from landing on the inner peripheral surfaces of the cylindrical insulating housings each placed between the ground electrode and each of the line electrodes. This prevents deteriorated insulation between each of the line electrodes and the ground electrode, otherwise caused by the sputtering.

Also, when a primary discharge occurs, sputtered particles of the discharge activating materials applied to the surfaces of the substantially conical discharging parts of the line electrodes land on the opposing substantially funnel-shaped inner surfaces of the penetration hole of the ground electrode, and sputtered particles of the discharge activating materials applied to the substantially funnel-shaped inner surfaces of the penetration hole of the ground electrode land on the opposing substantially conical discharging parts of the line electrodes. Therefore, the surfaces of the substantially conical discharging parts of the line electrodes and the substantially funnel-shaped inner surfaces of the penetration hole of the ground electrode keep supplementing the sputtered discharge activating materials to each other.

This prevents the discharge activating materials applied to the surfaces of the substantially conical discharging parts of the line electrodes and the substantially funnel-shaped inner surfaces of the penetration hole of the ground electrode from dispersing away due to sputtering and eventually disappearing, when primary discharges occur repeatedly over a long period of time between the substantially conical discharging parts of the line electrodes and the opposing substantially funnel-shaped inner surfaces of the penetration hole of the ground electrode. Therefore, the discharge activating materials remaining on the surfaces of the substantially conical discharging parts of the line electrodes and the substantially funnel-shaped inner surfaces of the penetration hole of the ground electrode cause primary discharges to occur repeatedly and stably over a long period of time in the oblique parallel gaps between the substantially conical discharging parts of the line electrodes and the opposing substantially funnel-shaped inner surfaces of the penetration hole of the ground electrode.

Additionally, when highly fluid discharge activating materials are applied to the surfaces of the substantially conical discharging parts of the line electrodes, the substantially conical shape thereof prevents the discharge activating materials from running down, pulled by gravity force, the surfaces of the substantially conical discharging parts of the line electrodes, and allows the discharge activating materials to be applied surely and substantially evenly to the surfaces of the substantially conical discharging parts of the line electrodes, compared with the conventional three-electrode-discharge surge arrester having the substantially cylindrically shaped discharging parts of the line electrodes.

Additionally, the three-electrode-discharge surge arrester according to the present invention is preferred to have annular concave portions on the boundaries between the substantially conical discharging parts and the adjacent peripheral parts on the line electrodes, respectively. The annular concave portions are used for collecting an excess amount of the discharge activating materials applied to the surfaces of the substantially conical discharging parts of the line electrodes.

In the three-electrode-discharge surge arrester having this structure, when liquefied discharge activating materials are applied to the surfaces of the substantially conical discharging parts of the line electrodes, an excess amount of the discharge activating materials, running down from the surfaces of the substantially conical discharging parts of the line electrodes toward the surfaces of the adjacent peripheral parts of the line electrodes, flows into the annular concave portions and is collected therein. Therefore, the three-electrode-discharge surge arrester having this structure prevents the discharge activating materials from being applied widely, affected by surface tension, around the surfaces of the peripheral parts of the line electrodes adjacent to the surfaces of the substantially conical discharging parts of the line electrodes. Hence, the three-electrode-discharge surge arrester having this structure prevents a primary discharge from occurring between the peripheral parts of the line electrodes and the opposing peripheral parts of the ground electrode, respectively, affected by the discharge activating materials applied around the surfaces of the peripheral parts of the line electrodes. Accordingly, the three-electrode-discharge surge arrester having this structure prevents a primary discharge from occurring unsurely in the oblique parallel gaps formed between the substantially conical discharging parts of the line electrodes and the opposing substantially funnel-shaped inner surfaces of the penetration hole of the ground electrode.

Other objects, features and advantages of the present invention will become more apparent from the following detailed description when read in conjunction with the accompanying drawings.

DETAILED DESCRIPTION OF THE PREFERRED EMBODIMENTS

A description will now be given, with reference to the drawings, of a three-electrode-discharge surge arrester of the present invention.

Figure 1:
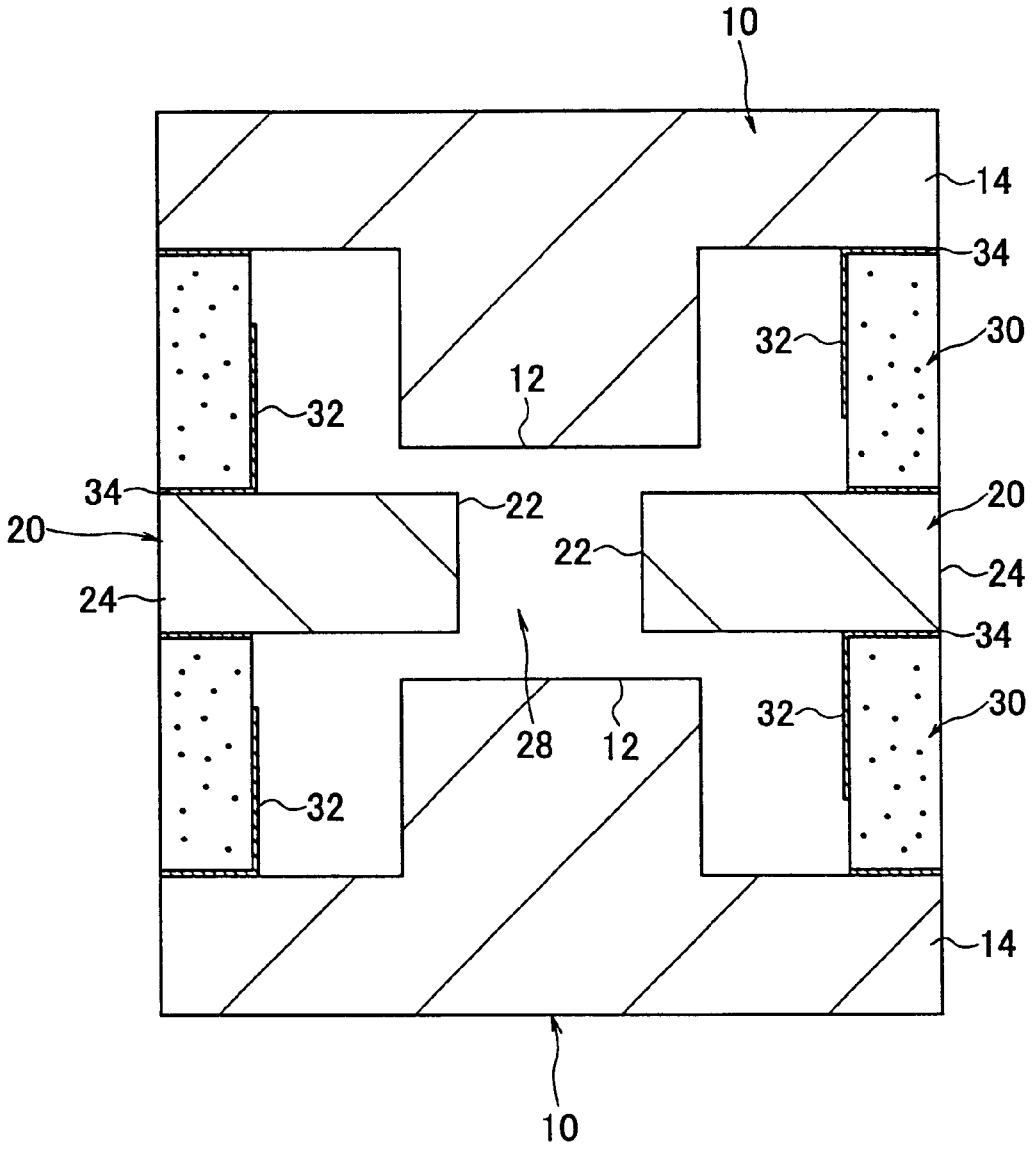
FIG.1 PRIOR ART
FIG. 1 is an illustration for explaining a structure of a conventional three-electrode-discharge surge arrester.
Figure 2:
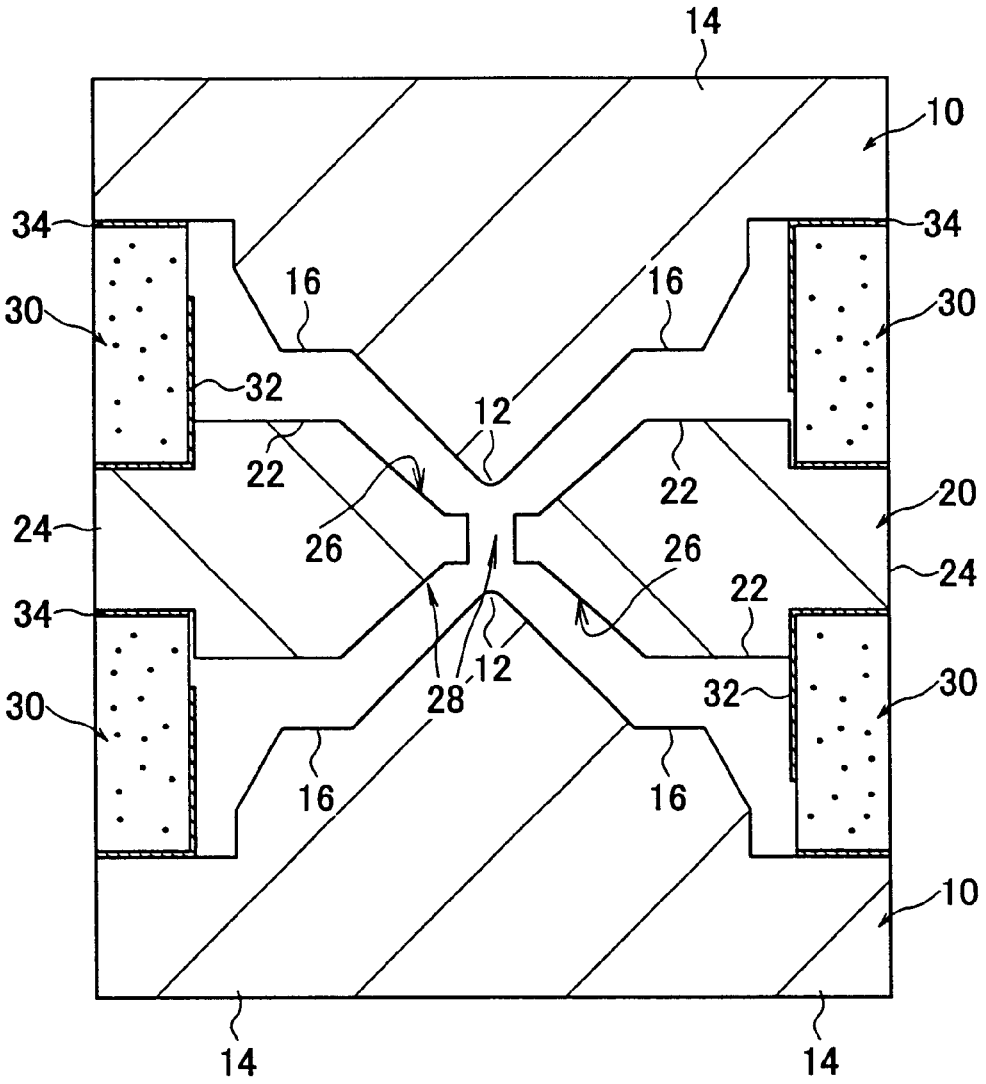
FIG. 2 is an illustration for explaining a structure of a three-electrode-discharge surge arrester of the present invention.
Figure 3:
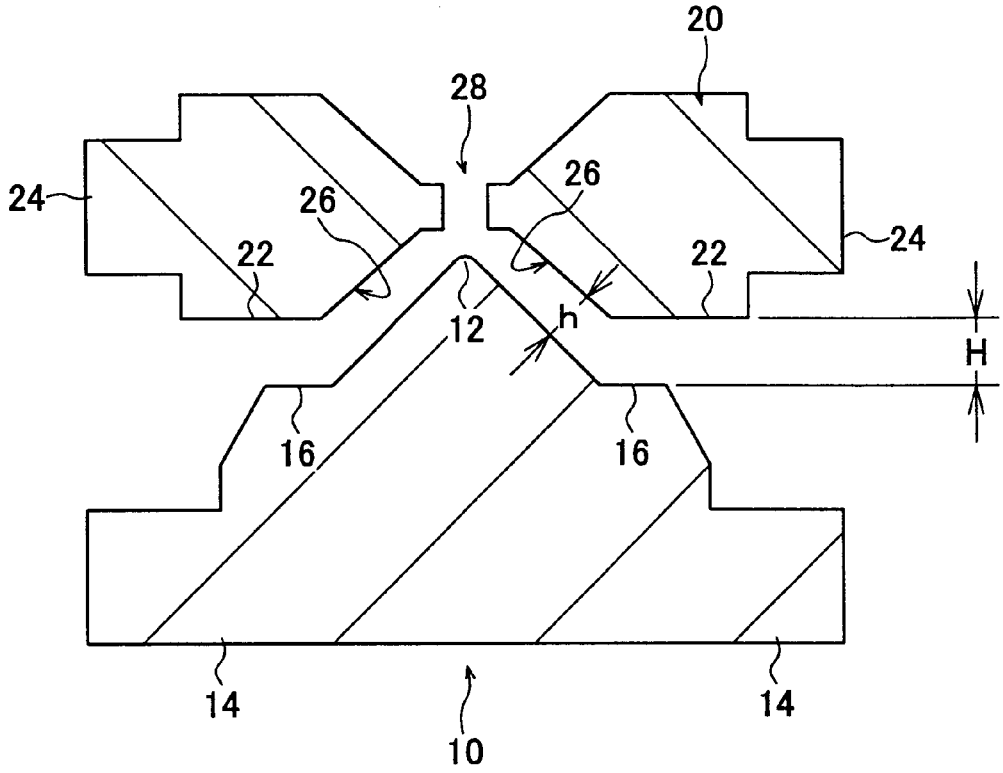
FIG. 3 is a partially enlarged illustration for explaining the structure of the three-electrode-discharge surge arrester of the present invention.

FIG. 2 and FIG. 3 illustrate a preferred embodiment of the three-electrode-discharge surge arrester of the present invention. FIG. 2 is an illustration for explaining a structure of the three-electrode-discharge surge arrester. FIG. 3 is a partially enlarged illustration for explaining the structure of the three-electrode-discharge surge arrester.

As shown in the figures, the three-electrode-discharge surge arrester has a pair of line electrodes 10 axially placed, with a predetermined gap therebetween, so that discharging parts 12 provided respectively on the inner edges of the pair of line electrodes 10 oppose each other. Between the opposing discharging parts 12 of the pair of line electrodes 10 is a ground electrode 20 provided with a penetration hole 28 in the center. The line electrodes 10 and the ground electrode 20 are formed of metals such as Fe—Ni alloys.

Between the ground electrode 20 and each of the line electrodes 10 is each of a pair of cylindrical insulating housings 30, within each of which the discharging part 12 of the line electrode 10 is inserted. The cylindrical insulating housings 30 are formed of insulators such as ceramic.

Circular electric terminals 14 formed respectively on the outer side of the pair of line electrodes 10 seal the outer openings of the pair of cylindrical insulating housings 30. A discharge gas is enclosed airtight in the inner space defined by the cylindrical insulating housings 30, the line electrodes 10 and the ground electrode 20.

A terminal 24 of the ground electrode 20 is held between the pair of cylindrical insulating housings 30. The circumference of the terminal 24 of the ground electrode 20 exposes itself between the pair of cylindrical insulating housings 30.

Metalized layers 34 are formed respectively on the upper and lower sides of the cylindrical insulating housings 30. The upper and lower sides of the cylindrical insulating housings 30 are respectively soldered to the circular electric terminals 14 and the terminal 24 by the metalized layers 34.

On the inner peripheral surfaces of the cylindrical insulating housings 30 are formed conductive trigger lines 32 parallel to the axis of the cylindrical insulating housings 30. The conductive trigger lines 32 are formed of such materials as carbon and are electrically connected to the circular electric terminals 14 of the line electrodes 10 and the terminal 24 of the ground electrode 20 by the metalized layers 34.

The above-mentioned structure is the same as a conventional three-electrode-discharge surge arrester. However, the three-electrode-discharge surge arrester shown in the figures has substantially conical discharging parts 12 of the line electrodes 10. To suit this shape, upper and lower parts of the penetration hole 28 of the ground electrode 20 each have substantially funnel-shaped inner surfaces 26. Each of the substantially conical discharging parts 12 of the line electrodes 10 is disposed in the inside space of the substantially funnel-shaped inner surfaces 26 of the upper and lower parts of the penetration hole 28, respectively. Between each of the substantially conical discharging parts 12 of the line electrodes 10 and its opposing substantially funnel-shaped inner surface 26 of the penetration hole 28 of the ground electrode 20 is an oblique parallel gap h for a primary discharge, as shown in FIG. 3.

Between a peripheral part 22 of the ground electrode 20 and its opposing peripheral part 16 of the line electrode 10 is, as shown in FIG. 3, a parallel gap H for a secondary discharge.

The oblique parallel gap h is narrower than the parallel gap H, as shown in FIG. 3. It is preferred that the oblique parallel gap h ranges from 0.10 mm to 0.80 mm in distance and the parallel gap H ranges from 0.16 mm to 1.70 mm in distance all the while the oblique parallel gap h is narrower than the parallel gap H. To provide the best properties and effects, it is most preferred that the oblique parallel gap h ranges from 0.25 mm to 0.35 mm in distance and the parallel gap H ranges from 0.40 mm to 0.75 mm in distance.

The three-electrode-discharge surge arrester shown in FIG. 2 and FIG. 3 has the above-mentioned structure.

In the three-electrode-discharge surge arrester, when a primary discharge occurs in the oblique parallel gaps h formed between each of the substantially conical discharging parts 12 of the line electrodes 10 and each of the substantially funnel-shaped inner surfaces 26 of the penetration hole 28 of the ground electrode 20, metal particles are sputtered from the substantially conical discharging parts 12 of the line electrodes 10 and the substantially funnel-shaped inner surfaces 26 of the penetration hole 28 of the ground electrode 20. However, the sputtering is blocked by the ground electrode 20 around the penetration hole 28 and the discharging parts 12 of the line electrodes 10, so that the sputtered metal particles are kept from landing on the inner peripheral surfaces of the cylindrical insulating housings 30 each of which is placed between the ground electrode 20 and each of the line electrodes 10 and has conductive trigger lines 32 formed thereon. This prevents deteriorated insulation, otherwise caused by the sputtering, between each of the line electrodes 10 and the ground electrode 20.

Also, the sputtered metal particles from the substantially conical discharging parts 12 of the line electrodes 10 land on the opposing substantially funnel-shaped inner surfaces 26 of the penetration hole 28 of the ground electrode 20, and the sputtered metal particles from the substantially funnel-shaped inner surfaces 26 of the penetration hole 28 of the ground electrode 20 land on the opposing substantially conical discharging parts 12 of the line electrodes 10. Therefore, the substantially conical discharging parts 12 of the line electrodes 10 and the substantially funnel-shaped inner surfaces 26 of the penetration hole 28 of the ground electrode 20 keep supplementing sputtered metals to each other.

This prevents changing significantly the width and length of the oblique parallel gaps h between the substantially conical discharging parts 12 of the line electrodes 10 and the substantially funnel-shaped inner surfaces 26 of the penetration hole 28 of the ground electrode 20, because metals forming the substantially conical discharging parts 12 of the line electrodes 10 and the substantially funnel-shaped inner surfaces 26 of the penetration hole 28 of the ground electrode 20, respectively, keep supplementing each other and do not eventually disappear, when primary discharges occur repeatedly over a long period of time between the substantially conical discharging parts 12 of the line electrodes 10 and the opposing substantially funnel-shaped inner surfaces 26 of the penetration hole 28 of the ground electrode 20. Therefore, stable and accurate discharges at a predetermined electric potential occur repeatedly over a long period of time in the oblique parallel gaps h between the substantially conical discharging parts 12 of the line electrodes 10 and the opposing substantially funnel-shaped inner surfaces 26 of the penetration hole 28 of the ground electrode 20.

Additionally, when a large surge voltage is provided between the circular electric terminals 14 of the line electrode 10 and the terminal 24 of the ground electrode 20, a primary discharge occurring in the oblique parallel gaps h between the substantially conical discharging parts 12 of the line electrodes 10 and the substantially funnel-shaped inner surfaces 26 of the penetration hole 28 of the ground electrode 20 is followed by a secondary discharge occurring in the relatively wider parallel gaps H between the peripheral parts 22 of the ground electrode 20 around the penetration hole 28 and the opposing peripheral parts 16 of the line electrodes 10. This secondary discharge occurring in the parallel gaps H surely eliminates the above-mentioned large surge voltage.

Additionally, because the oblique parallel gaps h are narrower than the parallel gaps H, when a not quite as large surge voltage is provided between the circular electric terminals 14 of the line electrode 10 and the terminal 24 of the ground electrode 20, a primary discharge occurs in the relatively narrower oblique parallel gaps h between the substantially conical discharging parts 12 of the line electrodes 10 and the substantially funnel-shaped inner surfaces 26 of the penetration hole 28 of the ground electrode 20. This primary discharge occurring in the oblique parallel gaps h surely eliminates the above-mentioned not quite as large surge voltage.

With this not quite as large surge voltage, since a secondary discharge does not occur in the relatively wider parallel gaps H between the peripheral parts 22 of the ground electrode 20 around the penetration hole 28 and the opposing peripheral parts 16 of the line electrodes 10, metal particles are kept from dispersing by sputtering from the peripheral parts 22 of the ground electrode 20 and the opposing peripheral parts 16 of the line electrodes 10 and landing on the inner peripheral surfaces of the cylindrical insulating housings 30. This prevents deteriorated insulation between each of the line electrodes 10 and the ground electrode 20, otherwise caused by the sputtering.

Additionally, because the discharging parts 12 of the line electrodes 10 are substantially conical and, to suit this shape, the inner surfaces 26 of the upper and lower parts of the penetration hole 28 of the ground electrode 20 are substantially funnel-shaped, the area of each of the oblique parallel gaps h formed therebetween for a primary discharge can be increased. Therefore, stable primary discharges occur repeatedly over a long period of time in the oblique parallel gaps h increased in area.

Additionally, the substantially conical discharging parts 12 of the line electrodes 10 can be easily and surely formed by coining.

Figure 4:
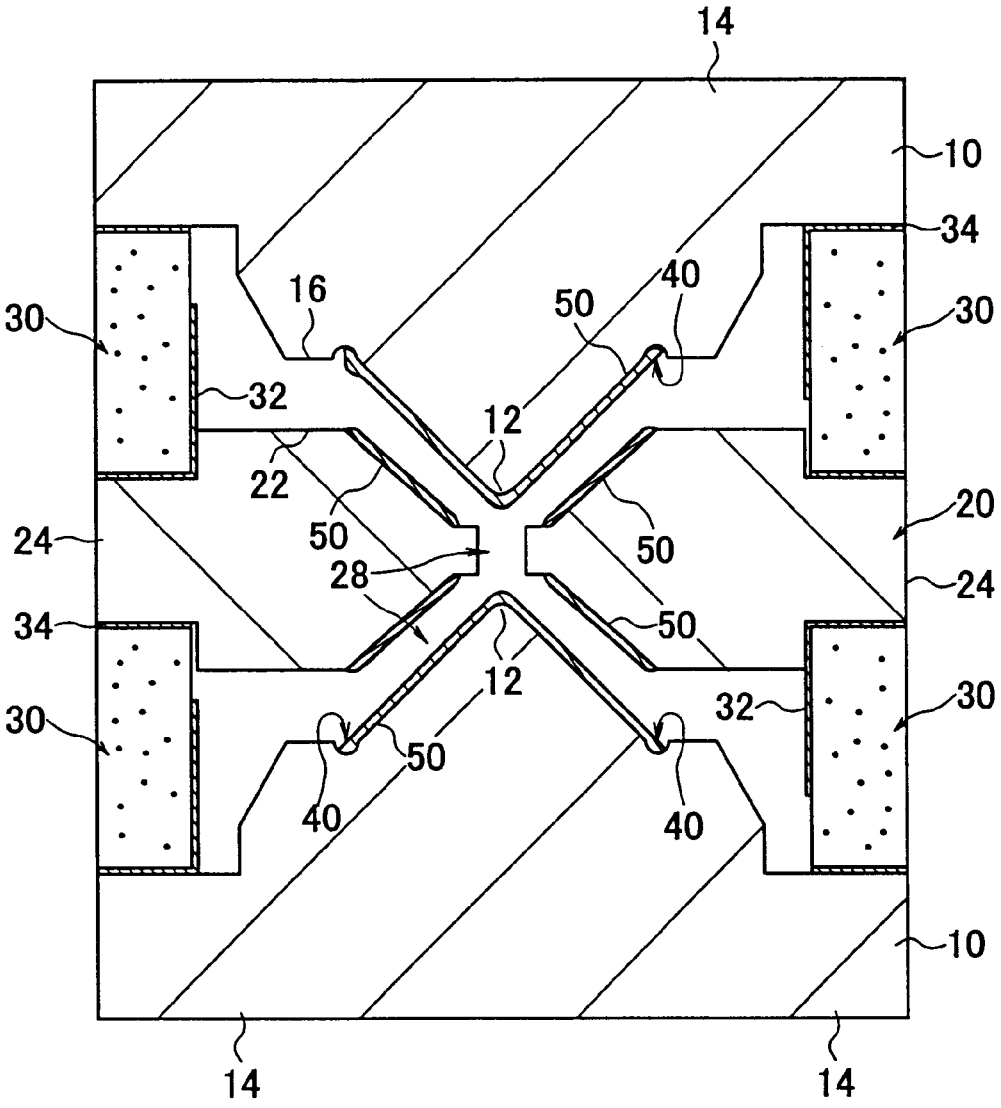
FIG. 4 is an illustration for explaining a structure of the three-electrode-discharge surge arrester of the present invention.

In the three-electrode-discharge surge arrester shown in FIG. 2 and FIG. 3, discharge activating materials 50, such as barium titanate ($BaTiO_3$), are preferred to be applied to the surfaces of the substantially conical discharging parts 12 of the line electrodes 10 and the substantially funnel-shaped inner surfaces 26 of the penetration hole 28 of the ground electrode 20, as shown in FIG. 4.

In this case, the discharge activating materials 50 applied to the surfaces of the substantially conical discharging parts 12 of the line electrodes 10 and the substantially funnel-shaped inner surfaces 26 of the penetration hole 28 of the ground electrode 20 cause a primary discharge to occur smoothly and surely in the oblique parallel gaps h between the substantially conical discharging parts 12 of the line electrodes 10 and the opposing substantially funnel-shaped inner surfaces 26 of the penetration hole 28 of the ground electrode 20.

Additionally, when a primary discharge occurs in the oblique parallel gaps h formed between each of the substantially conical discharging parts 12 of the line electrodes 10 and each of the substantially funnel-shaped inner surfaces 26 of the penetration hole 28 of the ground electrode 20, particles of the discharge activating materials 50 applied to the surfaces of the substantially conical discharging parts 12 of the line electrodes 10 and the substantially funnel-shaped inner surfaces 26 of the penetration hole 28 of the ground electrode 20 disperse by sputtering, affected by the discharge energy. However, the sputtering is blocked by the ground electrode 20 around the penetration hole 28 and the discharging parts 12 of the line electrodes 10, so that the sputtered materials are kept from landing on the inner peripheral surfaces of the cylindrical insulating housings 30 each of which is placed between the ground electrode 20 and each of the line electrodes 10. This prevents deteriorated insulation between each of the line electrodes 10 and the ground electrode 20, otherwise caused by the sputtering.

Also, when the primary discharge occurs in the oblique parallel gaps h, sputtered particles of the discharge activating materials 50 applied to the surfaces of the substantially conical discharging parts 12 of the line electrodes 10 land on the opposing substantially funnel-shaped inner surfaces 26 of the penetration hole 28 of the ground electrode 20, and sputtered particles of the discharge activating materials 50 applied to the substantially funnel-shaped inner surfaces 26 of the penetration hole 28 of the ground electrode 20 land on the opposing substantially conical discharging parts 12 of the line electrodes 10. Therefore, the surfaces of the substantially conical discharging parts 12 of the line electrodes 10 and the substantially funnel-shaped inner surfaces 26 of the penetration hole 28 of the ground electrode 20 keep supplementing the sputtered discharge activating materials 50 to each other.

This prevents the discharge activating materials 50 applied to the surfaces of the substantially conical discharging parts 12 of the line electrodes 10 and the substantially funnel-shaped inner surfaces 26 of the penetration hole 28 of the ground electrode 20 from dispersing away by sputtering and eventually disappearing, when primary discharges occur repeatedly over a long period of time between the substantially conical discharging parts 12 of the line electrodes 10 and the opposing substantially funnel-shaped inner surfaces 26 of the penetration hole 28 of the ground electrode 20. Therefore, the discharge activating materials 50 remaining on the surfaces of the substantially conical discharging parts 12 of the line electrodes 10 and the substantially funnel-shaped inner surfaces 26 of the penetration hole 28 of the ground electrode 20 cause primary discharges to occur repeatedly and stably over a long period of time in the oblique parallel gaps h between the substantially conical discharging parts 12 of the line electrodes 10 and the opposing substantially funnel-shaped inner surfaces 26 of the penetration hole 28 of the ground electrode 20.

Additionally, when highly fluid discharge activating materials 50 are applied to the surfaces of the substantially conical discharging parts 12 of the line electrodes 10, the substantially conical shape thereof prevents the discharge activating materials 50 from running down, pulled by gravity force, the surfaces of the substantially conical discharging parts 12 of the line electrodes 10, and allows the discharge activating materials 50 to be applied surely and substantially evenly to the surfaces of the substantially conical discharging parts 12 of the line electrodes 10.

Additionally, the three-electrode-discharge surge arrester shown in FIG. 2 and FIG. 3 is preferred to have annular concave portions 40 on the boundaries between the substantially conical discharging parts 12 and the adjacent peripheral parts 16 on the line electrodes 10, respectively, as shown in FIG. 4. The annular concave portions 40 are used for collecting an excess amount of the discharge activating materials 50 applied to the surfaces of the substantially conical discharging parts 12 of the line electrodes 10.

In the three-electrode-discharge surge arrester having this structure, when liquefied discharge activating materials 50 are applied to the surfaces of the substantially conical discharging parts 12 of the line electrodes 10, an excess amount of the discharge activating materials 50, running down from the surfaces of the substantially conical discharging parts 12 of the line electrodes 10 toward the surfaces of the adjacent peripheral parts 16 of the line electrodes 10, flows into the annular concave portions 40 and is collected therein. Therefore, the three-electrode-discharge surge arrester having this structure prevents the discharge activating materials 50 from being applied widely, affected by surface tension, around the surfaces of the peripheral parts 16 of the line electrodes 10 adjacent to the surfaces of the substantially conical discharging parts 12 of the line electrodes 10. Hence, the three-electrode-discharge surge arrester having this structure prevents a primary discharge from occurring between the peripheral parts 16 of the line electrodes 10 and the opposing peripheral parts 22 of the ground electrode 20, respectively, affected by the discharge activating materials 50 applied around the surfaces of the peripheral parts 16 of the line electrodes 10. Accordingly, the three-electrode-discharge surge arrester having this structure prevents a primary discharge from occurring unsurely in the oblique parallel gaps h formed between the substantially conical discharging parts 12 of the line electrodes 10 and the opposing substantially funnel-shaped inner surfaces 26 of the penetration hole 28 of the ground electrode 20.

The present invention is not limited to the specifically disclosed embodiment, and variations and modifications may be made without departing from the scope of the present invention.

The present application is based on Japanese priority application No. 2000-000218 filed on Jan. 5, 2000, the entire contents of which are hereby incorporated by reference.

What is claimed is:

1. A three-electrode-discharge surge arrester having two discharging parts of a pair of line electrodes, the two discharging parts opposing each other and defining a gap therebetween; a ground electrode disposed between said two discharging parts and provided with a penetration hole in the center thereof; and two cylindrical insulating housings between each of said line electrodes and said ground electrode, wherein each of said two discharging parts has a substantially conical shape; each of inner surfaces of upper and lower parts of said penetration hole is substantially funnel-shaped, in accordance with said substantially conical shape; and oblique parallel gaps for a primary discharge are formed between said inner surfaces of said upper and lower parts of said penetration hole and said two discharging parts, respectively, wherein parallel gaps for a secondary discharge are formed between peripheral parts of said ground electrode around said penetration hole and peripheral parts of said pair of line electrodes, respectively, each of the peripheral parts of said pair of line electrodes opposing each of said peripheral parts of said ground electrode around said penetration hole, and wherein each of said oblique parallel gaps is formed narrower than each of said parallel gaps.

2. The three-electrode-discharge surge arrester as claimed in claim 1, wherein a discharge activating material is applied to surfaces of said discharging parts having said substantially conical shape and said inner surfaces of said upper and lower parts of said penetration hole.

3. The three-electrode-discharge surge arrester as claimed in claim 2, wherein annular concave portions are formed on boundaries between said discharging parts and adjacent peripheral parts of said pair of line electrodes, respectively, so that said annular concave portions collect an excess amount of said discharge activating material applied to said surfaces of said discharging parts.

* * * * *